US006744365B2

(12) United States Patent
Sicuranza

(10) Patent No.: US 6,744,365 B2
(45) **Date of Patent: *Jun. 1, 2004**

(54) VEHICLE DOOR STOP SAFETY SYSTEM

(76) Inventor: Rosario G. Sicuranza, 2870 Rte. 104, East Quogue, NY (US) 11942

( * ) Notice: Subject to any disclaimer, the term of this patent is extended or adjusted under 35 U.S.C. 154(b) by 0 days.

This patent is subject to a terminal disclaimer.

(21) Appl. No.: 10/216,024

(22) Filed: Aug. 9, 2002

(65) Prior Publication Data

US 2002/0189168 A1 Dec. 19, 2002

Related U.S. Application Data

(63) Continuation-in-part of application No. 10/100,802, filed on Mar. 19, 2002, which is a continuation of application No. 09/737,131, filed on Dec. 14, 2000, now Pat. No. 6,362,735, which is a continuation-in-part of application No. 09/489,121, filed on Jan. 21, 2000, now abandoned.

(51) Int. Cl.[7] ..... G08B 13/00

(52) U.S. Cl. ..... 340/556; 340/557; 250/221; 296/146.1

(58) Field of Search ..... 340/556, 557, 340/552, 545.3, 686.6, 573.1, 551, 555; 49/26; 401/49; 250/221, 222.1; 296/146.1, 223, 216

(56) References Cited

U.S. PATENT DOCUMENTS

| | | | | | |
|---|---|---|---|---|---|
| 5,074,073 | A | * | 12/1991 | Zwebner | 49/26 |
| 5,424,717 | A | * | 6/1995 | Platt | 340/551 |
| 6,145,918 | A | * | 11/2000 | Wilbanks | 296/146.1 |
| 6,339,305 | B1 | * | 1/2002 | Ishihara | 318/445 |
| 6,362,735 | B2 | * | 3/2002 | Sicuranza | 340/556 |

* cited by examiner

*Primary Examiner*—Anh V La
(74) *Attorney, Agent, or Firm*—Carter, DeLuca, Farrell & Schmidt, LLP

(57) ABSTRACT

A vehicle door stop safety system for preventing closure of a vehicle door when an object moves between an open door and body of the vehicle. The system includes field producing device for producing a field adjacent to a latch end of the door, when the door is open; and sensing device for sensing an interruption of the field and for producing a block or stop signal when the interruption is sensed. Blocking device is provided for blocking closure of the door upon an interruption of the field. Alternatively, braking device is provided for stopping the door's movement at a position when an interruption of the field is sensed. A controller is provided for actuating the blocking or braking device upon sensing by the sensing device of an interruption of the field.

22 Claims, 11 Drawing Sheets

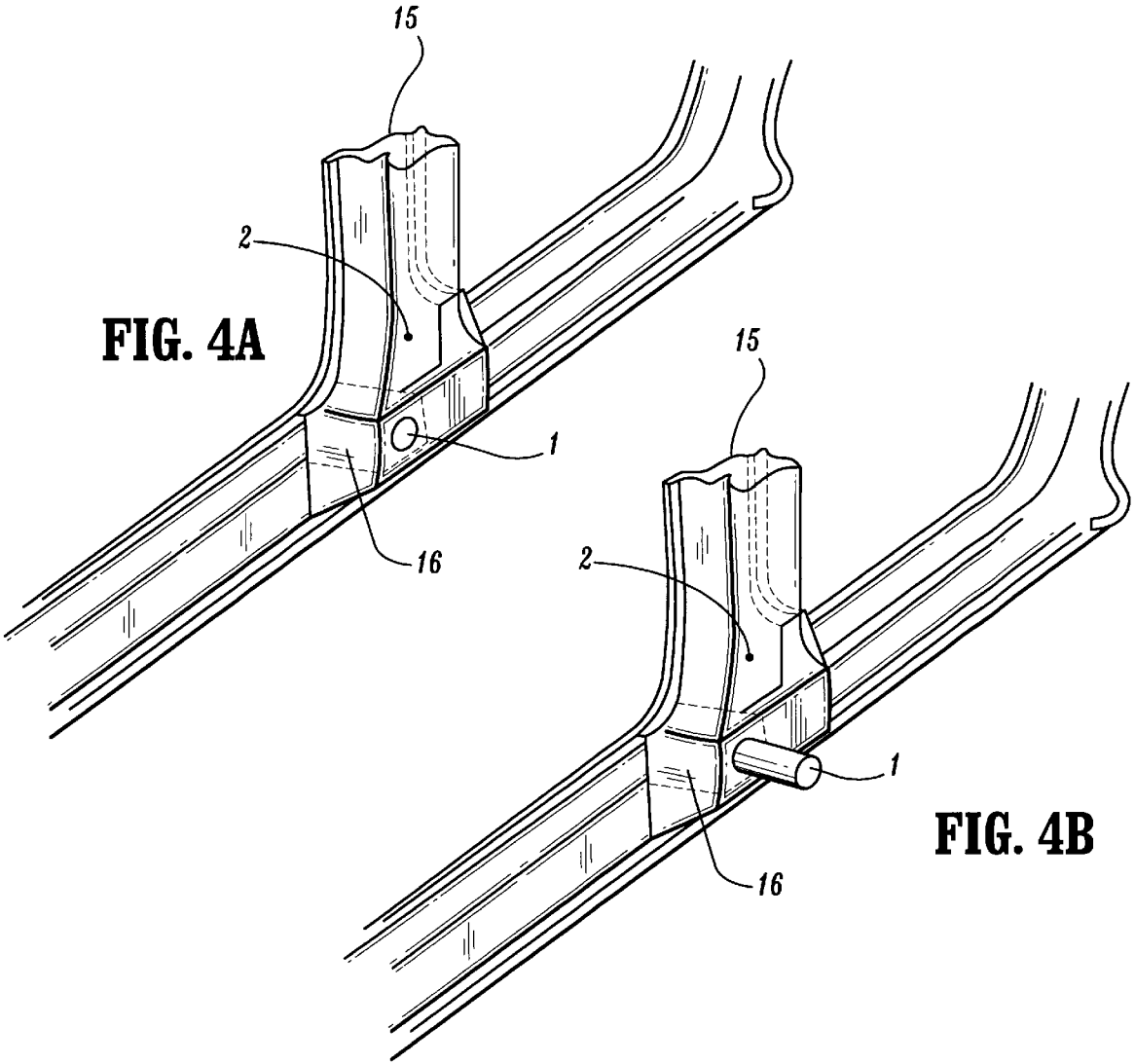
FIG. 4A
FIG. 4B
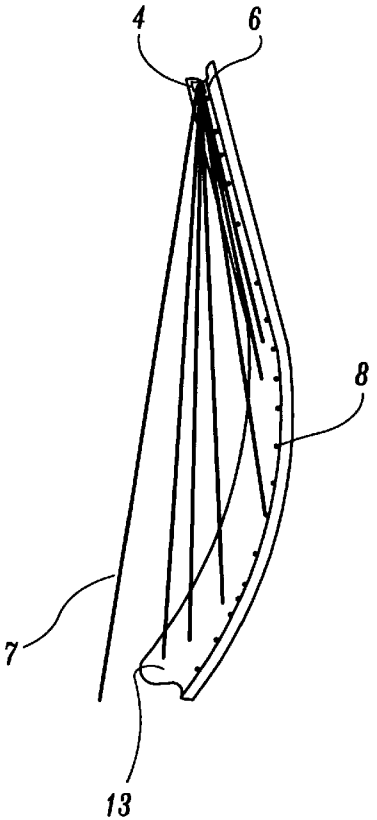
FIG. 3

VEHICLE DOOR STOP SAFETY SYSTEM

CROSS-REFERENCE TO RELATED APPLICATION

This application is a continuation-in-part of U.S. application Ser. No. 10/100,802 filed Mar. 19, 2002, which is a continuation of U.S. application Ser. No. 09/737,131 filed Dec. 14, 2000, now U.S. Pat. No. 6,362,735 issued Mar. 26, 2002, which is a continuation-in-part of U.S. application Ser. No. 09/489,121 filed Jan. 21, 2000, now abandoned.

BACKGROUND OF THE INVENTION

1. Field of the Invention

The present invention relates to vehicle door safety systems, and more particularly, pertains to a new vehicle door stop safety system for preventing closing of a door of a vehicle when an object moves between the open door and the body of the vehicle.

2. Description of the Prior Art

Automobiles are well-accepted vehicles in current science and technology. Current automobiles utilize a main body and at least one door, in addition to hoods over engine compartments and lids over trunks. The main body is usually an elongated, generally rectangular body and the doors extend outwardly therefrom. The doors can be located at virtually any position along the axis of the body. In addition, hoods and trunk lids are generally provided adjacent to the respective forward and rearward ends of the car body for the purpose of covering the engine and trunk compartments.

The doors are, of course, a very important aspect of the automobile in providing a means of ingress and egress to the vehicle. However, the use of the doors expose users, and in particular small children, to hazards such as the inadvertent closing of a door on a hand or fingers of a hand. This could result in the appendage being crushed or severed by the door.

Likewise, elderly people, or people just not paying attention to what they are doing, may inadvertently close the door on their hand or foot.

Infrared radiation has been used as door passageway sensors in the past. Moreover, fan shaped laser systems, as well as many of the individual components comprising the invention herein addressed, are known. For example, U.S. Pat. No. 5,424,717 discloses a laser light transmitter and proximity detector. Other patents which have been discovered during a patentability search include U.S. Pat. Nos. 5,331,577 and 5,969,603.

However, a need still exists for a vehicle door safety system that monitors and prevents injuries from closing doors on automobiles.

SUMMARY OF THE INVENTION

The present invention provides a new vehicle door stop safety system construction wherein the same can be utilized for preventing closing of a door of a vehicle when an object moves between the open door and the body of the vehicle.

By using a laser device to determine and sense the presence of an obstruction (e.g. a limb) in the vicinity of an open door, many hazards (and ensuing injuries) associated with the automotive industry may successfully be avoided. This invention is directed to vehicle sensing devices, in general, and in particular, to devices for sensing the position of a door relative to the buck or jam or slam plate or stanchion or door post portion of the body of the vehicle with the follow-up process of inhibiting an automobile door from closing and very likely causing bodily injury.

The present invention generally comprises field producing means for producing a field adjacent to a latch end of the door. The field producing means is mountable on the latch end of the door, and is adapted for operatively connecting to a door actuated switch of the vehicle such that the field producing means produces the field when the switch is actuated by opening of the door. Sensing means is provided for sensing an interruption of the field produced by the field producing means. The sensing means produces a block or stop signal when an interruption of the field is sensed. The sensing means is mountable on the latch end of the door of the vehicle. Blocking means is provided for blocking closure of the door when the sensing means detects an interruption of the field produced by the field producing means. The blocking means is mountable on the body of the vehicle adjacent to the door opening. Alternatively, a braking means is provided for stopping the door's movement at a position when an interruption of the field is sensed. Controller means is provided for actuating the blocking means upon sensing by the sensing means of an interruption of the field produced by the field producing means. The controller means is connected to the sensing means and the blocking means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The inventor does not believe that this type of laser technology, in the applications as stated herein, has ever been used in conjunction with a solenoid type doorstop, power cut devices, or braking devices to prevent injury as a result of the momentum of a closing motor vehicle door or hood.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The foregoing, as well as other features and advantages of the present invention which have not yet been discussed, will be more clearly understood from the following drawings, (in which preferred embodiments of the invention are described):

FIG. 3 is a schematic end view illustrating an automobile door utilizing a fan-shaped laser type of beam, in which locations of certain enumerated aspects of the present invention are depicted and follow in close proximity to the inside edge of the automobile door: a fan-shaped laser beam producing device 6, a fan-shaped laser beam 7, and a sensor strip device 8 extending along the inside of the edge of the door 13;

FIGS. 4A and 4B are schematic views illustrating a door post portion 15 of an automobile body with a door closed switch 2, where FIG. 4A depicts a doorstop member 1 in a retracted condition and FIG. 4B depicts the doorstop member 1 in an extended condition;

FIG. 6C is a side plan view of the braking mechanism and FIG. 6D is a top plan view of the braking mechanism;

FIG. 6F is a side plan view of the braking mechanism taken along line 6F—6F of FIG. 6E;

FIG. 6G is a side plan view of the braking mechanism in a normal state and FIG. 6H illustrates the braking mechanism in the braking state;

DESCRIPTION OF PREFERRED EMBODIMENTS

With reference now to the drawings, and in particular to FIGS. 1 through 9B thereof, a new vehicle door stop safety system embodying the principles and concepts of the present invention will be described.

The present invention comprises an apparatus for monitoring whether an object is positioned so as to obstruct the closure of a door of a vehicle, such as when a hand of a person grips a latch end of the door or is simply positioned between the latch end of the door and a door post portion of the body of the vehicle as when the door is in the open position.

Figure 1:
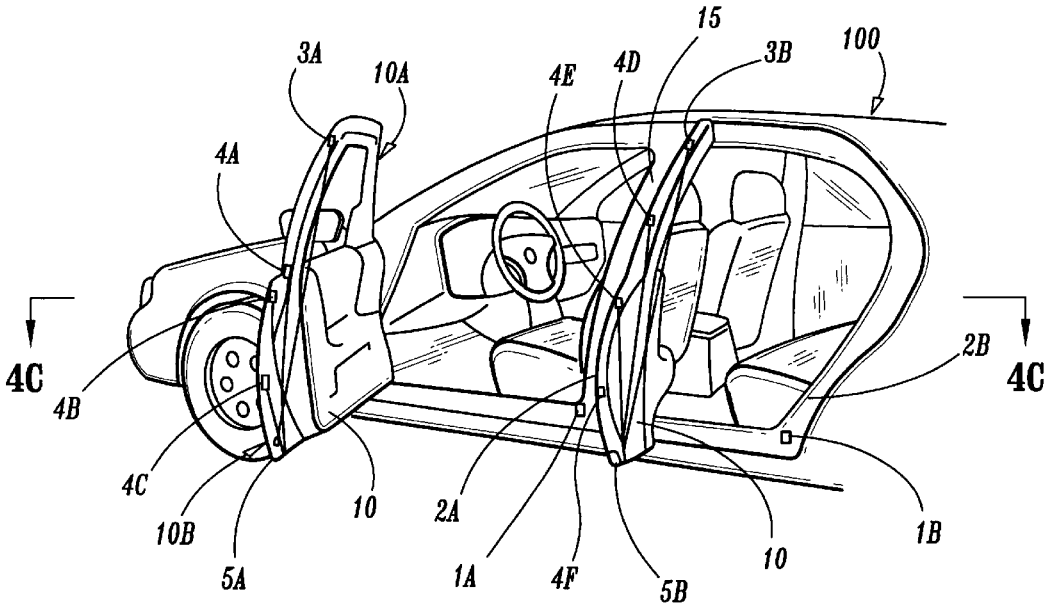
FIG. 1 is a schematic side view illustrating an automobile with doors open in which locations of certain enumerated aspects of the present invention are depicted and follow in close proximity to an inside edge of the automobile doors: doorstop members 1A and 1B, switches 2A and 2B, laser beam producing devices 3A and 3B, lenses 4A through 4F, and sensors 5A and 5B.
Figure 2:
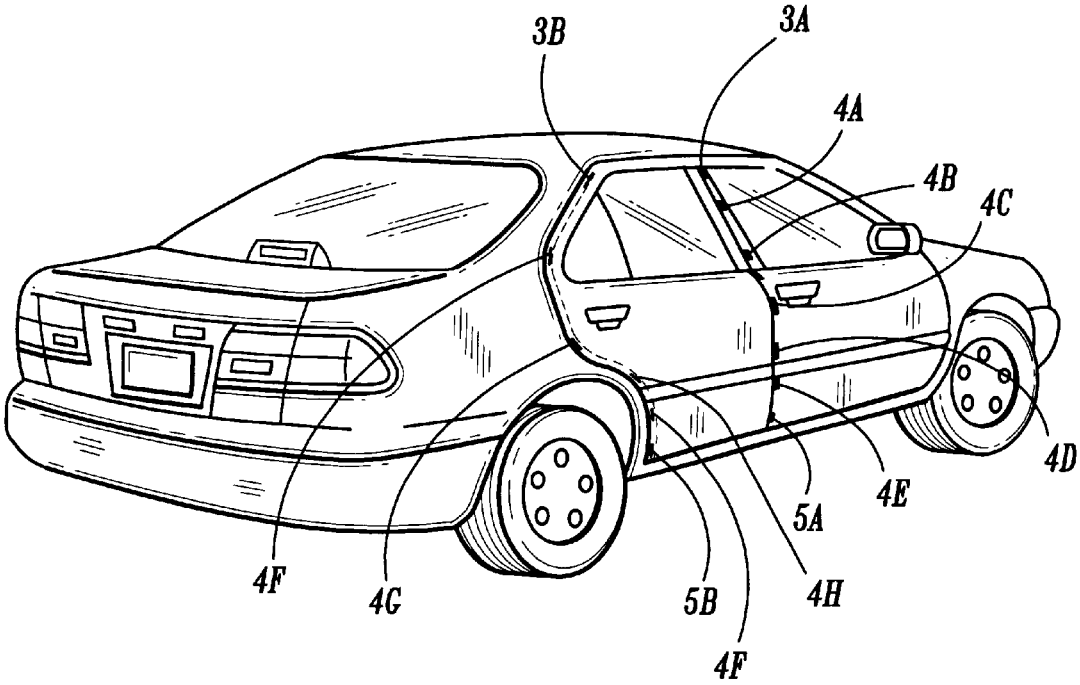
FIG. 2 is a schematic side view illustrating an automobile with doors closed in which locations of certain enumerated aspects of the present invention are depicted and follow in close proximity to an outside edge of the automobile doors: laser beam producing devices 3A and 3B, lenses 4A through 4H, and sensors 5A and 5B.

As illustrated in FIG. 1, the vehicle is of the type having a body 100 with a door opening formed therein, and a door 10 hingedly mounted to the body adjacent to the door opening such that the door 10 is movable between a closed position in the door opening and an open position away from the door opening. In practice, this may include side doors of automobiles, as well as rear hatch doors and even sliding doors commonly found on minivans. The door 10 has a hinge end 10A and a latch end 10B. The door opening of the body 100 has a door post portion 15 for abutting the latch end 10B of the door 10 when the door 10 is in the closed position. The vehicle further typically has a door closed switch 2A, 2B that is actuated when the door of the vehicle is moved out of the closed position, typically by a portion of the door moving out of abutment with a plunger of the switch 2A, 2B.

The apparatus includes a field producing means 3A, 3B for producing a field adjacent to the latch end 10B of the door. The field producing means may be mountable on the latch end 10B of the door 10, and may be integrated on the vehicle as a part of the vehicle manufacturing practice or may comprise an aftermarket product that is installed after manufacture of the vehicle. The field producing means is adapted for being operatively connected to the door closed switch 2A, 2B of the vehicle such that the field producing means produces the field when the switch is actuated by the opening of the door, and so that the field is not produced when the door is in the closed position. In the most preferred embodiment, the field producing means 3A, 3B generates a field of light for detecting a presence of obstructions. However, the field may also be, for example, comprised of electric or sound waves.

The field producing means 3A, 3B includes a light source for producing a beam of light. Preferably, the light source produces a coherent laser light beam. To produce the coherent laser light beam, the light source may comprise at least one light emitting diode. The field producing means further includes a lens assembly for transmitting the beam of light therethrough and for directing the beam to desired locations. The lens assembly comprises at least one lens 4 (4A through 4F), and the lens 4 is positioned relative to the light source such that the light source shines the light beam through the lens 4. Alternatively, the lens assembly may comprise at least two lenses. The two lenses may be configured such that light from the light source passes through the lenses in tandem, or one after another, with a portion of the light beam being diverted for creating the field of light while another portion of the light beam continues on to the next lens. The non-diverted portion of the light beam may be directed along the interior of the door to another lens, where another portion of the light beam is diverted toward sensing means 5A, 5B, which will be described in detail below. Optionally, the lenses may be configured such that light from the light source passes through the lenses in parallel to create generally parallel beams of light that travel in spaced paths to comprise a portion of the field of light. The lens assembly may include a plurality of refractory lenses for positioning on the latch end 10B of the door 10 to change the direction of the light beam (or portions of the light beam) emanating from the light source such that the light beam travels approximately parallel along an edge of the latch end of the door for directing the light beam toward the sensing means (see, e.g., FIGS. 1 and 2).

Referring now to FIG. 3, in one preferred embodiment of the invention, the lens assembly 4 is adapted such that the field of light comprises a sheet of light 7 created from a light beam emitted by light source 6. Preferably, the sheet of light 7 is substantially fan-shaped and radiates outwardly from the lens assembly substantially in a plane. The lens assembly may include an aperture that is adapted to divide the light beam from the light source 6 into a plurality of light beams forming the fan-shaped sheet of light 7. The sheet of light may be an approximately 5 mm thick fan-shaped sheet which may extend over a divergence angle of about 40 degrees. The lens assembly is mountable on an upper location of an inside edge 13 of the latch end 10B of the door so as to project the substantially fan-shaped sheet of light in a downward direction toward a lower location on the inside of the door 13. The light source 6 may be mounted in a manner such that the plane of the substantially fan-shaped sheet of light 7 is oriented substantially perpendicular to an axis of the inside of the door 13 that extends between the hinge end 10A and latch end 10B of the door. While the light beam, or sheet of light, may be directed in directions other than downward, the downward direction of the light beam reduces the chance that the light beam will be directed into the eyes of persons standing adjacent to the door of the vehicle.

The field producing means may also include control circuitry for connecting to the door closed switch 2A, 2B of the vehicle and the light beam producing diode. The control circuitry is thus able to cause the field producing means, or laser diodes, to produce the field of light when the switch is actuated by opening of the door.

The sensing means is provided for sensing an interruption of the field produced by the field producing means, such as by a hand or other object. The sensing means is mountable on the latch end 10B of the door 10 of the vehicle, or may be integrated in such position during the vehicle manufacture process. The sensing means is adapted to produce a block or stop signal when an interruption of the field is sensed. In one embodiment of the invention, the sensing means comprises at least one light sensor 5A, 5B for mounting on the latch end 10B of the door 10 (see FIG. 1). Optionally, a plurality of light sensors may be mounted in a spaced linear array configuration along the latch end 10B of the door for detecting portions of the sheet of light produced by the field producing means. The plurality of light sensors are preferably electrically connected in a series circuit such that any one of the sensors detecting an obstruction will produce the block signal. Optionally, a substantially continuous sensor strip 8 may be provided which is mountable on the inside edge 13 of the latch end 10B of the door 10 of the vehicle (see FIG. 3).

Significantly, blocking means is provided for blocking closure of the door when the sensing means detects an interruption of the field produced by the field producing means. The blocking means may be mountable on the body of the vehicle adjacent to the door opening (although it is within the scope of the invention to have the blocking means mounted on the door of the vehicle for performing the same function).

As illustrated in FIGS. 4A and 4B, the blocking means comprises a solenoid 16 that may be mounted on the door post portion 15 of the body of the vehicle. A doorstop member 1 is selectively extendable from the solenoid 16. The doorstop member 1 has an extended position (see FIG. 4B) wherein the doorstop member 1 is extended so as to prevent the door of the vehicle from moving into the closed position in the door opening, and the doorstop member 1 has a retracted position (see FIG. 4A) wherein the doorstop member does not obstruct the door from moving into the closed position.

Figure 5:
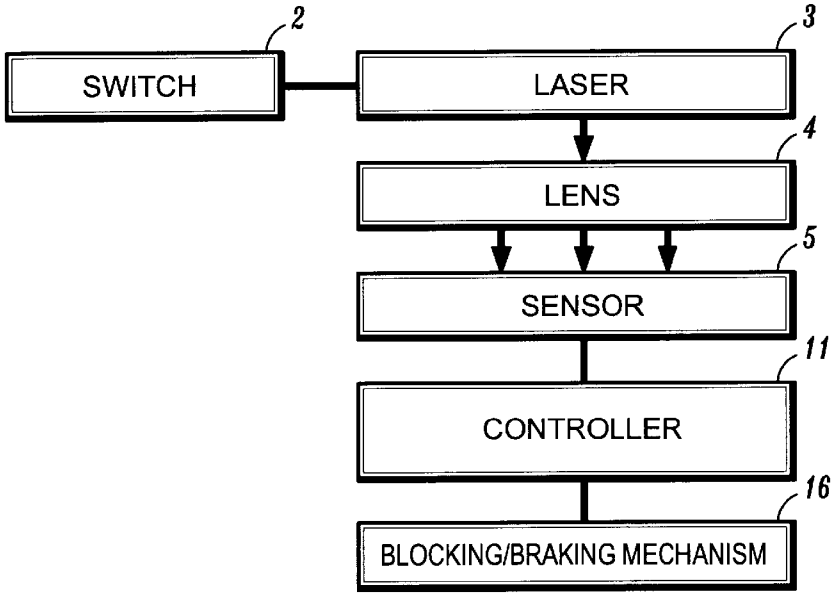
FIG. 5 is a schematic block diagram of the vehicle door stop safety system of the present invention.

Controller means may be provided for actuating the blocking means upon sensing by the sensing means of an interruption of the field produced by the field producing means. The controller means is connected to the sensing means and the blocking means, as illustrated in FIG. 5. In one embodiment of the invention, the controller means 11 comprises a relay/power feed controller connected to the solenoid 16 such that the controller 11 may selectively energize the solenoid 16 to move the doorstop member 1 into the extended position.

Figure 4C:
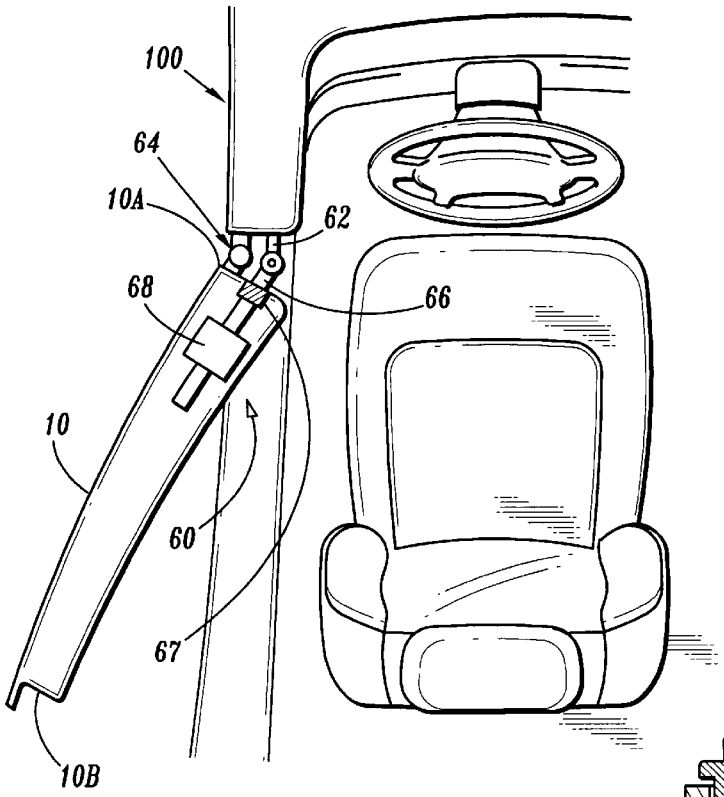
FIG. 4C is a partial cross-sectional view of the automobile shown in FIG. 1 taken along line 4C—4C which illustrates another embodiment of the present invention where a braking mechanism is employed to prevent the door of the automobile from closing.

Additionally, a braking means or mechanism may be employed in accordance with the present invention where the braking mechanism is responsive to the block or stop signal generated upon a detected obstruction and where the braking mechanism will cause the door to stop or brake at a certain position instead of just preventing full closure of the door. FIG. 4C is a partial cross-sectional view of the automobile shown in FIG. 1 taken along line 4C—4C which illustrates an embodiment of the present invention where a braking mechanism is employed to prevent the door of the automobile from closing.

Figure 4D:
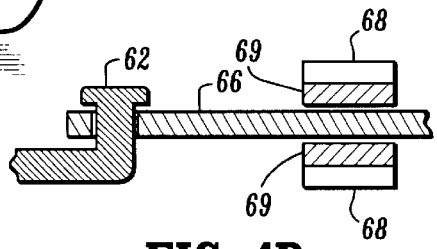
FIG. 4D illustrates a detail of the braking mechanism of the embodiment shown in FIG. 4C.

Referring to FIGS. 4C and 4D, a braking means or mechanism 60 is provided to positively stop the door 10 at a certain position instead of allowing the door to come into contact with the blocking means. The braking mechanism 60 includes a pin connection 62 coupled to the body 100 of the automobile in close proximity of a hinge 64 of the door 10. A braking bar 66 is coupled to the pin connection 62 in a manner which allows the braking bar 66 to slide within a bushing 67 mounted on the hinge end 10A of the door as the door opens and closes. FIG. 4D illustrates one such connection between the pin connection 62 and braking bar 66 where the bar 66 rotatably engages the pin 62. The braking mechanism 60 further includes braking calipers 68 which close down upon the braking bar 66 in response to a block or stop signal and, in turn, stops the door at a position when the stop signal is detected. Optionally, the braking calipers may include brake pads 69. The braking calipers 68 preferably will be fixed to the inside of the door, but may pivot with the braking bar to remain in line with it, and may be actuated hydraulically, pneumatically, electrically or by a spring-mounted device.

Figure 4E:
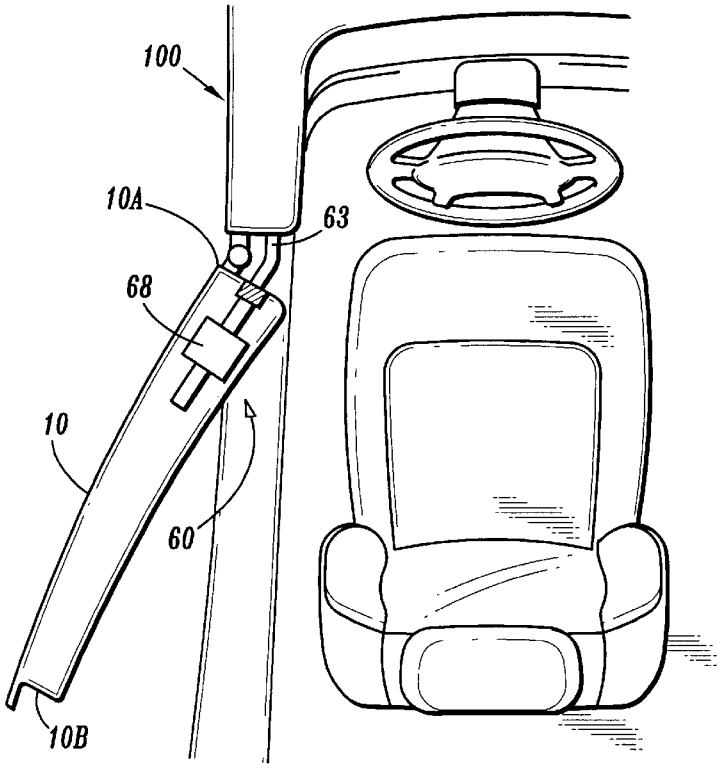
FIG. 4E is a partial cross-sectional view of the automobile shown in FIG. 1 taken along line 4C—4C which illustrates a further embodiment of the present invention employing a braking mechanism to prevent the door of the automobile from closing.

FIG. 4E illustrates a further embodiment of the present invention employing a braking mechanism to prevent the door of the automobile from closing. Similar to the embodiment shown in FIG. 4C, the braking mechanism 60 includes braking calipers 68, but instead of a pin connection and braking bar, the embodiment of FIG. 4E includes a single braking bar 63 which is rigidly fixed to the body 100 of the automobile. In all other aspects, the braking mechanism of FIG. 4E operates in the same manner as the embodiment shown in FIG. 4C. Furthermore, it is to be understood the braking mechanisms of FIGS. 4C and 4E may be mounted on the body 100 of the automobile and the pin connection and braking bars may be mounted to the hinge end 10A of the door.

Figure 6A:
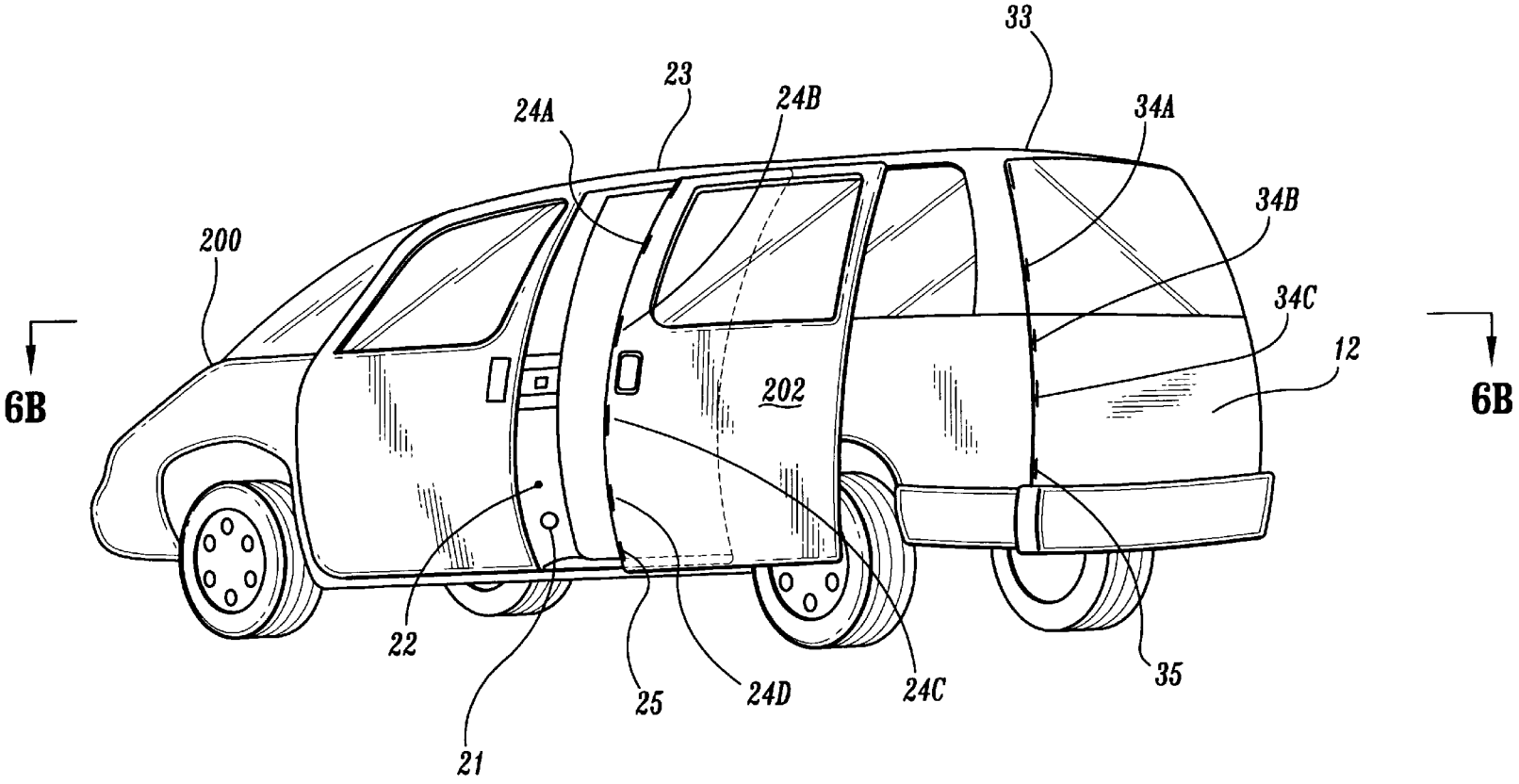
FIG. 6A is a schematic side view illustrating a minivan type vehicle with a rear cargo hatch 12 closed and a side sliding passenger door 202 partially open and a door post portion exposed with locations of certain enumerated aspects of the present invention depicted: a doorstop member 21; a switch 22; laser beam producing devices 23 and 33, lenses 24A through 24D and 34A through 34C, and sensors 25 and 35.

The door stop system of the present invention may also be applied to minivans where sliding doors and cargo hatch doors are employed. FIG. 6A is a schematic side view illustrating a minivan type vehicle with a rear cargo hatch 12 closed, a side sliding passenger door 202 partially open and the door post portion exposed with locations of certain enumerated aspects of the present invention depicted: a doorstop member 21; a switch 22; laser beam producing devices 23 and 33, lenses 24A through 24D and 34A through 34C, and sensors 25 and 35. In this embodiment, upon a detection of an obstruction by the sensing means 25, a block signal will be generated and the doorstop member 21 will be actuated to prevent the door from fully closing. Doorstop member 21 has substantially the same structure and function as the blocking means described above in conjunction with FIGS. 4A and 4B.

Figure 6B:
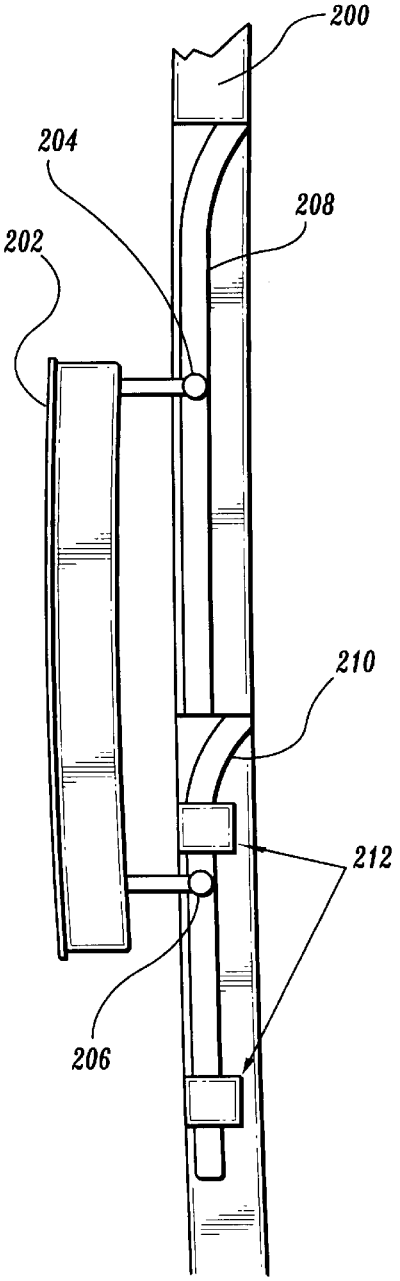
FIG. 6B is a partial cross-sectional view of the minivan shown in FIG. 6A taken along line 6B—6B which illustrates another embodiment of the present invention where a braking mechanism is employed to prevent the door of the minivan from sliding closed.
Figure 6C:
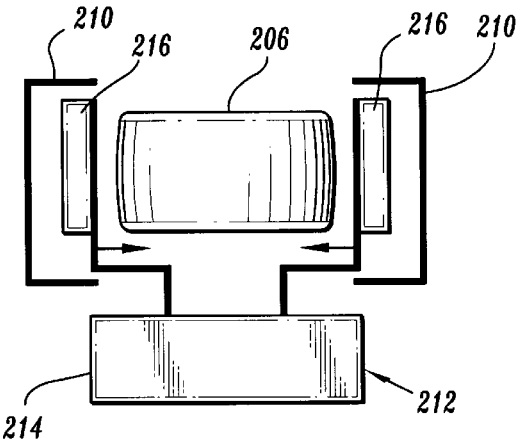
FIGS. 6C and 6D illustrate details of the braking mechanism employed in the embodiment of FIG. 6B, where
Figure 6D:
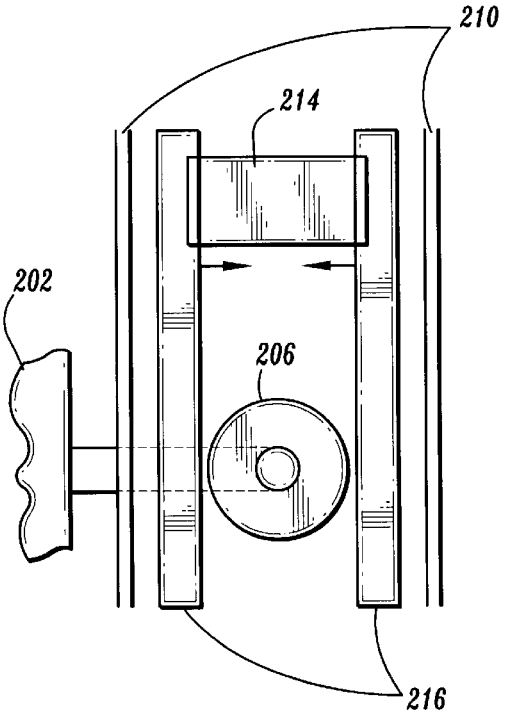

Referring to FIGS. 6B through 6D, FIG. 6B is a partial cross-sectional view of the minivan shown in FIG. 6A taken along line 6B—6B which illustrates an embodiment of the present invention where a braking mechanism is employed to prevent the door of the minivan from sliding closed. In a conventional minivan, a door 202 includes a plurality of rollers 204, 206 coupled to the door to allow the door to slide relative to the body 200 of the minivan. The rollers 204, 206 usually engage at least one track 208 and possibly a second track 210 which are mounted to the body 200 of the minivan. Additionally, rollers and corresponding tracks may be located at the top and bottom of the sliding door. The present invention contemplates a braking mechanism 212 which when activated applies brake pads to at least one roller 204, 206 of the door 202 to stop the door at a certain position and prevent its closing.

FIGS. 6C and 6D illustrate details of the braking mechanism 212 employed in the embodiment of FIG. 6B, where FIG. 6C is a side plan view of the braking mechanism and FIG. 6D is a top plan view of the braking mechanism. The braking mechanism 212 includes at least one actuator 214 and a pair of elongated brake pads 216. The elongated brake pads 216 are positioned in parallel to each other and are positioned within at least one track 208, 210 of the vehicle. Each of the elongated brake pads 216 is coupled to the actuator 214, and upon a block or stop signal, the actuator 216 will move the brake pads 216 in a direction perpendicular to the track 210, as indicated by the arrows, to come into contact with the rollers and to stop the door 202 from further movement.

Figure 6E:
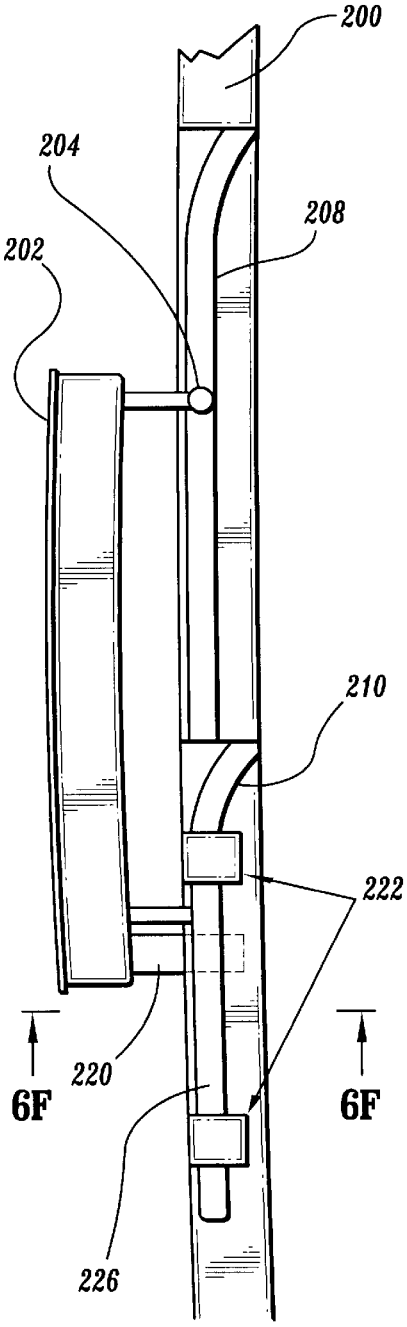
FIG. 6E is a partial cross-sectional view of the minivan shown in FIG. 6A taken along line 6B—6B which illustrates a further embodiment of the present invention where a braking mechanism is employed to prevent the door of the minivan from sliding closed.
Figure 6F:
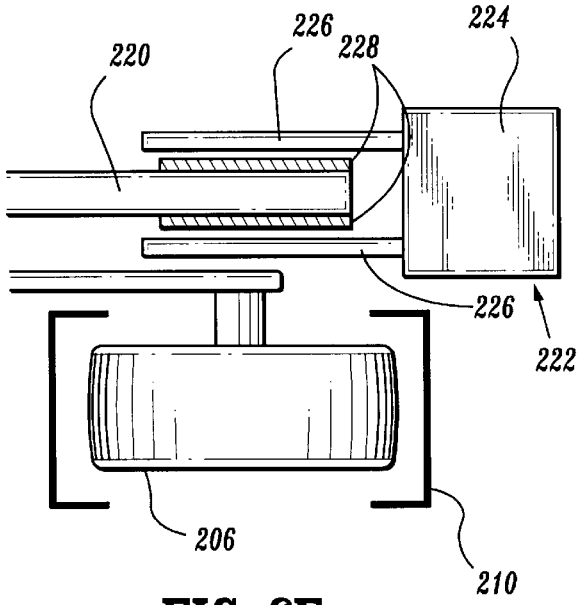
FIG. 6F illustrates details of the braking mechanism employed in the embodiment of FIG. 6E, where

FIG. 6E illustrates a further embodiment of the door stop system of the present invention employing a braking mechanism in conjunction with a sliding door of a minivan. In this embodiment, a braking bar 220 is coupled to door 202. Referring to FIG. 6F, a braking mechanism 222 including at least one actuator 224 and a pair of elongated brake rails 226 is positioned above the track 210 and is rigidly fixed to the body 200 of the minivan. The braking bar 220 will ride in between the elongated brake rails 226 when the door 202 is opened and closed under normal conditions. When a block or stop signal is generated, the actuator 224 will cause the elongated brake rails 226 to clamp down upon the brake bar 220 of the door 202 to stop the door and prevent its closing. Optionally, the brake bar 220 may include brake pads 228, as shown in FIG. 6F, or the elongated brake rails 226 may be lined with brake pads (not shown).

Figure 6G:
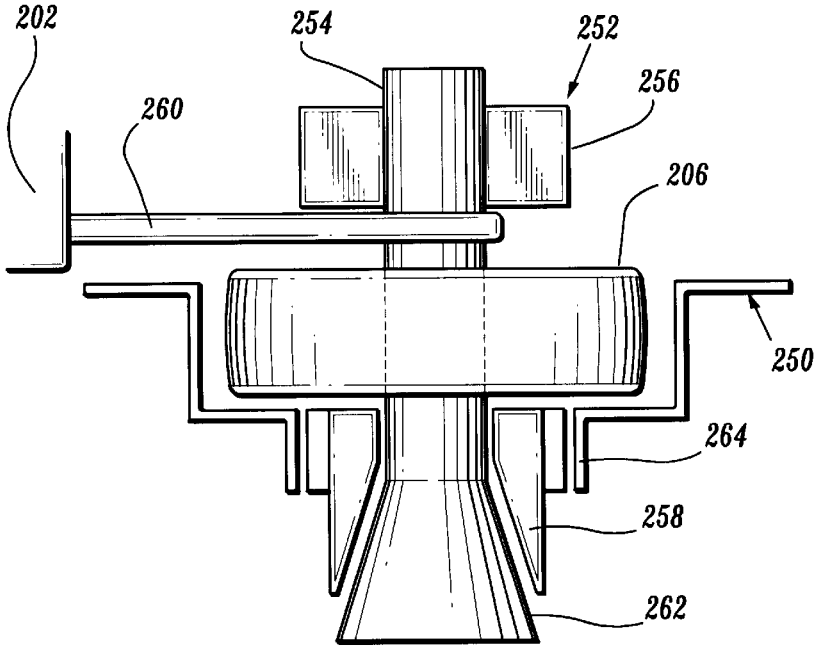
FIGS. 6G and 6H illustrate another embodiment of a braking mechanism in accordance with the present invention where
Figure 6H:
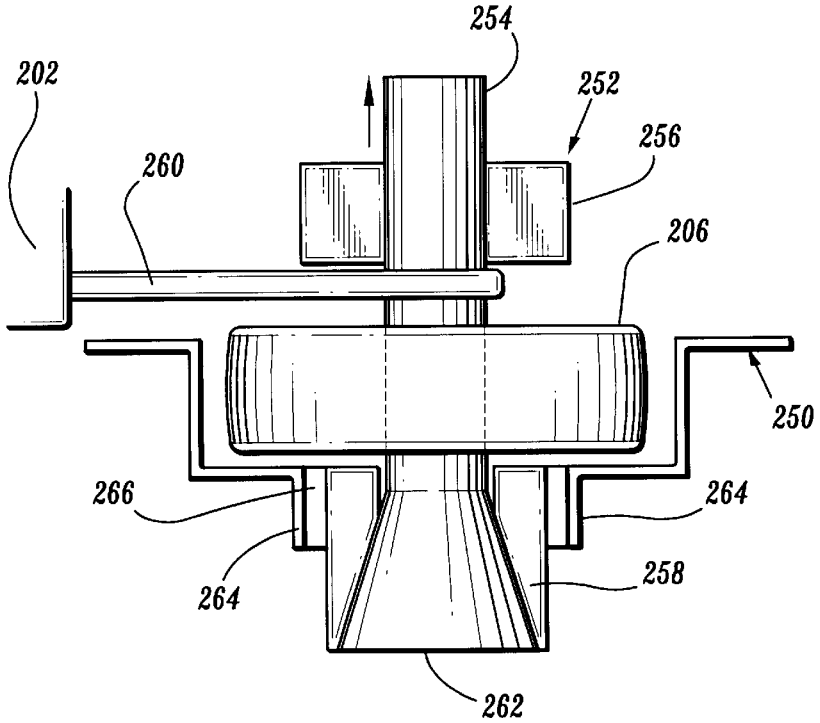

FIGS. 6G and 6H illustrate yet another embodiment of a braking mechanism employed in conjunction with a sliding door of a minivan. In this embodiment, the rollers 206, 208 of the door 202 (shown in partial) engage a track 250 with a step-like configuration. This step-like track 250 allows braking mechanism 252 to ride along with the roller 206. The braking mechanism 252 includes a pin 254, an actuator 256 and a braking cylinder 258. The pin 254 couples the roller 206 to an attachment bracket 260 of the door 202, supports the actuator 256 and carries the braking cylinder 258 along its lower end.

FIG. 6G illustrates the braking mechanism 252 in an unactuated state where the door 202 can ride freely along the track 250. FIG. 6H illustrates the braking mechanism 252 in a brake state. Upon detection of an obstruction, a block or stop signal is generated which activates the braking mechanism 252. Upon activation, the actuator 256 causes the pin 254 to move in an upward direction, which, in turn, causes a lower portion 262 of the pin 254 to engage the braking cylinder 258. As the lower portion 262 of the pin rises, it raises the braking cylinder 258 until the braking cylinder 258 comes into contact with a lower portion 264 of the track 250 causing the door 202 to stop. Optionally, the braking cylinder 258 may include a brake pad 266. It is to be understood that the braking mechanism 252 may be employed on one roller or a plurality of braking mechanisms may be employed on several rollers.

Figure 7A:
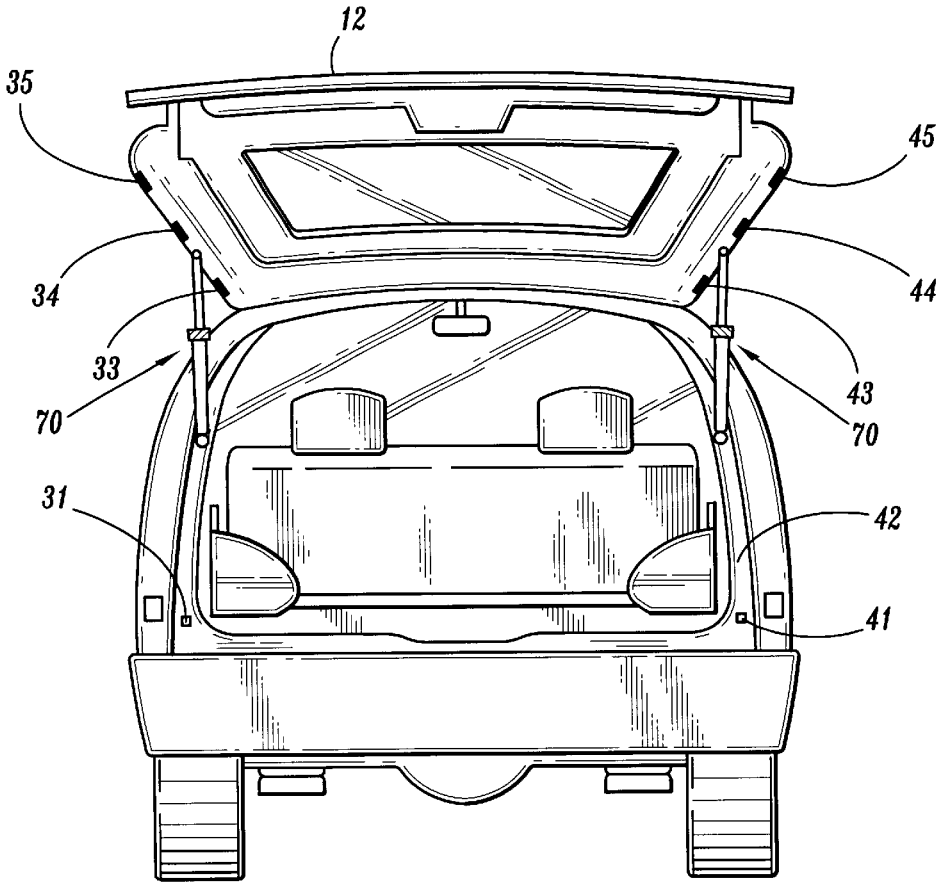
FIG. 7A is a schematic view illustrating a minivan type vehicle cargo hatch in the open position with locations of certain enumerated aspects of the present invention depicted: doorstop members 31 and 41, switch 42, laser beam producing devices 33 and 43, lenses 34 and 44, sensors 35 and 45, and actuators 70.

Furthermore, the door stop system of the present invention may be applied to a rear cargo hatch door 12 of a minivan. In one embodiment as shown in FIG. 7A, the door stop system includes doorstop members 31 and 41, switch 42, laser beam producing devices 33 and 43, lenses 34 and 44, and sensors 35 and 45. In this embodiment, doorstop members 31 and 41 have substantially the same structure and function as the blocking means described above in conjunction with FIGS. 4A and 4B.

Figure 7B:
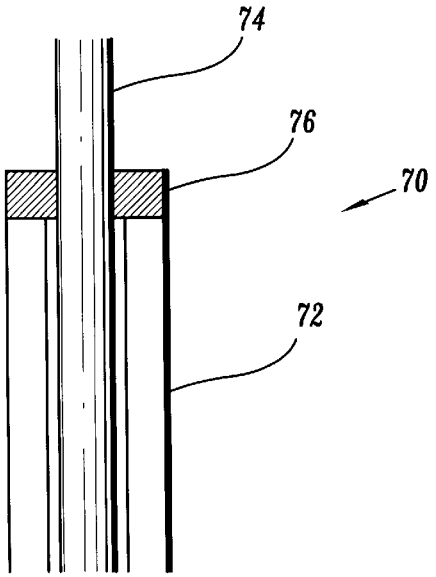
FIG. 7B illustrates a partial detail of a cargo hatch actuator as shown in FIG. 7A where the actuator is employed to prevent the closing of the cargo hatch door.
Figure 8A:
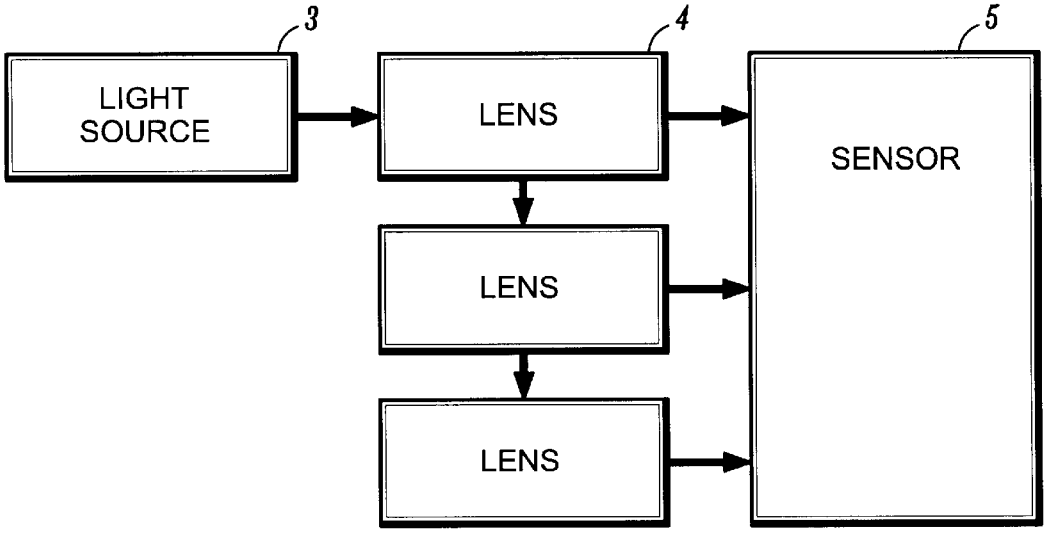
FIGS. 8A and 8B are schematic block diagrams illustrating the light producing assemblies and sensors.
Figure 8B:
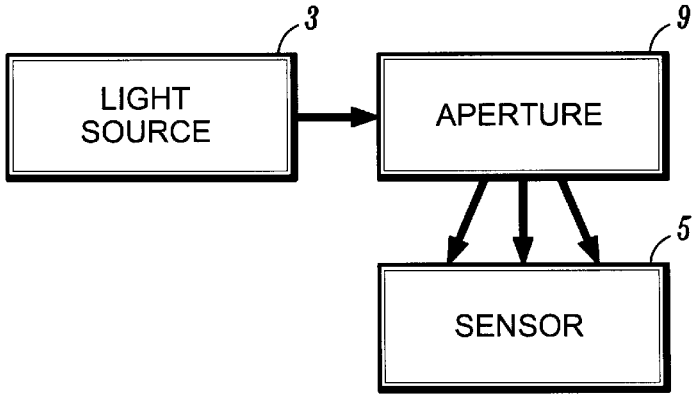

Referring to FIGS. 7A and 7B, another embodiment of the door stop system employs a braking mechanism 76 in conjunction with supporting actuators 70 of the cargo hatch door 12. Normally, a cargo hatch door 12 of a minivan or SUV (Sport Utility Vehicle) includes at least one supporting actuator 70 to assist a user in opening and closing of the cargo hatch door 12, where the actuator includes a cylinder 72 and a rod 74 coupled to the automobile's body and door as is known in the art. In accordance with the present invention, braking mechanism 76 is mounted on an end of the cylinder 72 that accepts the rod 74. The braking mechanism 76 may be of the caliper-type where two brake pads will clamp down on rod 74 to prevent further movement upon generation of a block or stop signal.

Figure 9A:
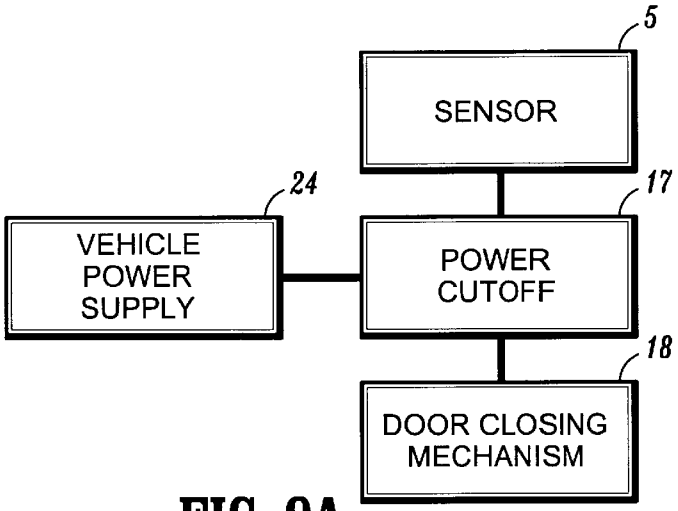
FIGS. 9A and 9B are schematic block diagrams of optical applications of the system of the present invention to sliding door closure mechanisms and window closing mechanisms.

Optionally, as illustrated in FIG. 9A, power cutting means 17 may be provided for cutting power to a closing mechanism 18 adapted for automatically closing the door, such as a sliding door on a minivan type of vehicle. The power cutting means 17 is connectable between a power supply 24 of the vehicle and the closing mechanism, and the power cutting means 17 is adapted to provide power to the closing mechanism 18 under normal conditions, while interrupting the supply of power to the closing mechanism 18 when an obstruction is detected and continuing the interruption until the obstruction is removed from the field.

Figure 9B:
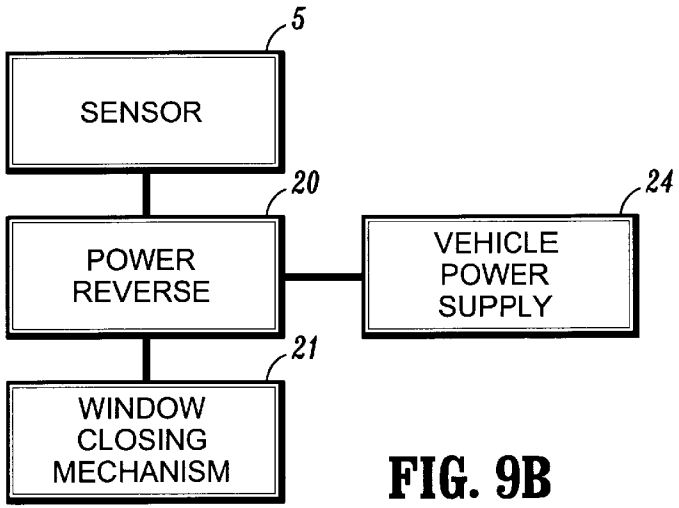

Retracting means may be provided for retracting (or opening) a window upon sensing by the sensing means an obstruction of the field produced by the field producing means. As illustrated in FIG. 9B, the retracting means may take the form of a power reversing circuit 20 that provides the necessary polarity of power to the window closing mechanism 21 to operate the mechanism in the ?open ? direction. The sensor means would most preferably be oriented adjacent to the window opening for detecting the presence of a hand in the opening of the window.

Optionally, modulating means may be provided for causing the light beam from the light source to be modulated at a predetermined frequency. Signal processing means may be provided that is responsive to proximity signals (produced by the sensor means) for producing an output to signify the presence of an object intercepting the light beam. The signal processing means may include synchronous detecting means, driven by the modulating means, for detecting the proximity signals so as to reduce or eliminate noise in the signals. Comparator means may be provided to compare the detected proximity signals with a reference signal to produce an output. The proximity signals may be transmitted in parallel to receptor diodes to act as a backup in the event of fault of receptivity by the sensor means.

It should be realized that the type of automobile on which the invention is employed is not critical, nor is the arrangement and/or type of door. Further, while not specifically shown or described, the same system with the operation discussed hereinabove, can be applied to a rear cargo door, a front engine hood or a rear trunk lid.

It should be understood that, while particular illustrative embodiments shown and described herein utilize a laser light source, the light source may be replaced by any suitable type of signal-generating mechanism. For example, in some instances, an electromagnetic wave type, a microwave type, a radio beam type or any other suitable signal projection device can be utilized. Likewise, the sensing mechanism can be a light-receiving or light-sensitive device, an electromagnetic beam sensitive device, or the like.

One example of such signal projection device is a fiber optic conduit, sensitive to the touch, (and/or an electric or electronic contact switch) mounted along the edge of the door to act in conjunction with the controller to trigger the solenoid, electric cut off, or braking device. In use, any pressure, i.e., an obstruction, applied to the fiber optic conduit or casing will effectively pinch the light beam contained therein and create an interruption necessary for the sensing means to produce a block signal, and thus, deploying the stop solenoid, braking mechanism, power cutoff device, reversing means, etc.

The specific mounting devices and techniques are omitted for clarity. Additionally, the positioning of the detectors and the signal generators can be positioned in other locations. For example, the signaling device may be placed on the vehicle body with the detector also mounted on the body. However, while it is believed that operations of such a configuration might be more difficult to implement and to calibrate, this configuration is contemplated by the instant invention. As noted, the sensors and/or sensor apparatus can take any number of suitable or desirable forms and configurations. Moreover, the energy source or light source (laser) or the solenoid door stop may be located anywhere on the door or door post portion of the automobile body. It is believed that the edge of the latch end of the door is the most appropriate place for mounting the signal source to most efficiently and quickly sense interference with a closing door such that the doorstop may be effectively extended to prevent closing of the door and causing injury to persons or objects lying in the path of the closing door.

It should be further noted that the representations shown herein are for convenience and are not intended to depict the entire automobile. Along these lines, the design of existing automobiles need not be altered in any fashion to accommodate the present invention. Moreover, the components of the automobiles and associated parts (as shown in the above drawings) are intended to be representational only and are not limitative of the invention.

Although the present invention has been illustrated and described with reference to preferred embodiments thereof, it should be understood that it is in no way limited to the details of such embodiments but is capable of numerous modifications within the scope of the appended claims. Therefore, there is shown and described a unique design and concept of a vehicle door stop safety system. The particular configuration shown and described herein relates to devices for sensing the presence of an object in proximity of a closing car door relative to its jamb located on the car body. While this description is directed to particular embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A system for monitoring whether an object is positioned so as to obstruct the closure of a door of a vehicle, the vehicle being of the type having a body with a door opening formed therein and a door operatively mounted adjacent to the door opening such that the door is movable between a closed position in the door opening and an open position away from the door opening, the door having a first end and a second end, the vehicle further having a switch that is actuated when the door of the vehicle is moved out of the closed position, the system comprising:

field producing means for producing a field adjacent to at least one end of the door, the field producing means being adapted for operatively connecting to the switch of the vehicle such that the field producing means produces the field when the switch is actuated by opening of the door;

sensing means for sensing an interruption of the field produced by the field producing means, the sensing means producing a stop signal when an interruption of the field is sensed;

braking means for stopping movement of the door at a position when the sensing means detects an interruption of the field produced by the field producing means; and controller means for actuating the braking means upon sensing by the sensing means of an interruption of the field produced by the field producing means, the controller means being connected to the sensing means and the braking means.

2. The system as in claim 1, wherein said door is a rear cargo hatch.

3. The system as in claim 1, wherein said door is a sliding door.

4. The system as in claim 1, wherein said field producing means is mountable on the at least one end of the door.

5. The system as in claim 1, wherein said field producing means is mountable on the door opening of the vehicle body.

6. The system as in claim 1, wherein said sensing means is mountable on the at least one end of the door.

7. The system as in claim 1, wherein said sensing means is mountable on the door opening of the vehicle body.

8. The system as in claim 1, wherein said braking means is mountable on the body of the vehicle.

9. The system as in claim 1, wherein said braking means is mountable on the at least one end of the door.

10. A system for monitoring whether an object is positioned so as to obstruct the closure of a door of a vehicle, the vehicle being of the type having a body with a door opening formed therein and a door operatively mounted adjacent to the door opening such that the door is movable between a closed position in the door opening and an open position away from the door opening, the door having a first end and a second end, the vehicle further having a switch that is actuated when the door of the vehicle is moved out of the closed position, the system comprising:

a field producing device for producing a field adjacent to at least one end of the door, the field producing device being adapted for operatively connecting to the switch of the vehicle such that the field producing device produces the field when the switch is actuated by opening of the door;

at least one sensor for sensing an interruption of the field produced by the field producing device, the at least one sensor producing a stop signal when an interruption of the field is sensed;

a braking device for stopping movement of the door at a position when the at least one sensor detects an interruption of the field produced by the field producing device; and a controller for actuating the braking device upon sensing by the at least one sensor of an interruption of the field produced by the field producing device, the controller being connected to the at least one sensor and the braking device.

11. The system as in claim 10, wherein the braking device includes a braking bar and braking calipers, wherein upon a stop signal, the braking calipers engage the braking bar to prevent further movement of the door.

12. The system as in claim 11, wherein the braking calipers further include brake pads.

13. The system as in claim 11, wherein the braking bar is mountable to the body of the vehicle and the braking calipers are mountable to the door of the vehicle.

14. The system as in claim 11, wherein the braking bar is mountable to the door of the vehicle and the braking calipers are mountable to the body of the vehicle.

15. The system as in claim 11, wherein the braking bar further comprise a pin connection for rotatably coupling the braking bar to the vehicle.

16. The system as in claim 10, wherein the door further comprises at least one roller to engage at least one track of the vehicle body to allow the door to slide relative to the vehicle body.

17. The system as in claim 16, wherein the braking device comprises at least one actuator and a pair of elongated brake pads, wherein upon a stop signal, the actuator causes the brake pads to come into contact with the at least one roller to prevent movement of the door.

18. The system as in claim 17, wherein the brake pads are located within the at least one track of the body.

19. The system as in claim 16, wherein the braking device comprises at least one actuator and a pair of elongated brake pads, and the door further comprises a braking bar which extends from the door and slides between the brake pads during opening and closing of the door, wherein upon a stop signal, the actuator causes the brake pads to come into contact with the braking bar to prevent movement of the door.

20. The system as in claim 16, wherein the braking device comprises:

a pin for coupling the braking device to the at least one roller;

an actuator supported by a first end of the pin; and a braking cylinder carried by a second end of the pin, wherein upon a stop signal, the actuator causes the pin to move in a direction away from the roller causing the pin to engage the braking cylinder resulting in the braking cylinder engaging the at least one track to prevent movement of the door.

21. The system as in claim 10, wherein the door is a cargo hatch door and the vehicle further includes at least one supporting actuator to assist in the opening and closing of the cargo hatch door, the at least one supporting actuator includes a rod and a cylinder engaging the rod, wherein the braking device is a brake caliper mountable on the cylinder where upon a stop signal the brake caliper engages the rod to prevent movement of the door.

22. A system for monitoring whether an object is positioned so as to obstruct the closure of a door of a vehicle, the vehicle being of the type having a body with a door opening formed therein and a door operatively mounted adjacent to the door opening such that the door is movable between a closed position in the door opening and an open position away from the door opening, the door having a first end and a second end, the vehicle further having a switch that is actuated when the door of the vehicle is moved out of the closed position, the system comprising:

a field producing device for producing a field adjacent to at least one end of the door, the field producing device being adapted for operatively connecting to the switch of the vehicle such that the field producing device produces the field when the switch is actuated by opening of the door;

at least one sensor for sensing an interruption of the field produced by the field producing device, the at least one sensor producing a stop signal when an interruption of the field is sensed;

a braking device for stopping movement of the door at a position when the at least one sensor detects an interruption of the field produced by the field producing device, wherein the braking device includes a braking bar and braking calipers, wherein upon a stop signal, the braking calipers engage the braking bar to prevent further movement of the door; and a controller for actuating the braking device upon sensing by the at least one sensor of an interruption of the field produced by the field producing device, the controller being connected to the at least one sensor and the braking device.

* * * * *